US008556196B2

(12) United States Patent
Lawyer et al.

(10) Patent No.: US 8,556,196 B2
(45) Date of Patent: Oct. 15, 2013

(54) QUICK CHANGE NOZZLE

(75) Inventors: Jerry D. Lawyer, Clermont, FL (US); Scott A. Caspary, Clermont, FL (US)

(73) Assignee: Senniger Irrigation Inc., Clermont, FL (US)

( * ) Notice: Subject to any disclaimer, the term of this patent is extended or adjusted under 35 U.S.C. 154(b) by 1244 days.

(21) Appl. No.: 12/215,661

(22) Filed: Jun. 30, 2008

(65) Prior Publication Data

US 2009/0321543 A1 Dec. 31, 2009

(51) Int. Cl.
*B05B 1/00* (2006.01)

(52) U.S. Cl.
USPC ..... 239/600; 239/390; 239/442

(58) Field of Classification Search
USPC ..... 239/390–393, 395, 397, 442, 600
See application file for complete search history.

(56) References Cited

U.S. PATENT DOCUMENTS

| | | | | |
|---|---|---|---|---|
| 3,799,453 | A | 3/1974 | Hart | |
| 5,234,169 | A | 8/1993 | McKenzie | |
| 5,699,962 | A | 12/1997 | Scott et al. | |
| 6,676,038 | B2 * | 1/2004 | Gressett et al. | 239/296 |
| 6,871,795 | B2 | 3/2005 | Anuskiewicz | |

* cited by examiner

*Primary Examiner* — Christopher Kim
(74) *Attorney, Agent, or Firm* — William M. Hobby, III

(57) ABSTRACT

An irrigation sprinkler apparatus has a rapid change nozzle which allows the changing of a nozzle without the use of tools or any disassemble of the sprinkler head. The rapid change nozzle slides into a window in the side of the sprinkler head and latches into place.

15 Claims, 6 Drawing Sheets

QUICK CHANGE NOZZLE

BACKGROUND OF THE INVENTION

The present invention relates to irrigation sprinklers and especially to an irrigation sprinkler having a rapid change nozzle.

A variety of irrigation systems are used throughout the world or irrigating crops and groves. One common system used for irrigation is a sprinkler system having a plurality of sprinkler heads coming from a central water supply line for distributing water over a surface area. These systems may use a moving supply line for irrigating food crops, groves and the like. The sprinkler units typically have replaceable nozzles so that different nozzles may be selected and mounted in the sprinkler unit to achieve a desired range or rate of coverage or simply to replace a defective nozzle. An irrigation system may also have many different sprinkler units of the same type with each having different nozzles and it is sometimes desirable and necessary to change the nozzles often for a given area to obtain an optimum irrigation of an area of coverage. This requires maintaining different sprinkler nozzles and selecting the nozzle for a particular coverage after a sprinkler system is installed. Many current nozzles are removably attached to a sprinkler head in which the nozzle or a cover for the nozzle is threadedly attached which requires unscrewing a nozzle or cap for the nozzle, finding a replaceable nozzle, and attaching the new nozzles onto the sprinkler unit. This is sometimes difficult because the nozzle is positioned so it cannot be gripped easily to unscrew the nozzle or to simply pull out the nozzle in the case of a press-fitted nozzle.

The present invention is directed towards an irrigation sprinkler with a rapid change nozzle which can be snapped-in from the side of the sprinkler outlet and then unsnapped and removed.

In the past, there have been various types of improvements in removable sprinkler nozzles, as seen in the McKenzie U.S. Pat. No. 5,234,169 for a removable sprinkler nozzle in which the nozzle fits in a recessed seat and has a rotatable upper cover and a camming surface formed on the cover which extends down into engagement with the nozzle. The cam surface is shaped to push the nozzle at least partially out of its seat during rotation of the cover to allow a user to be able to grip the nozzle and complete its removal by pulling outward on the nozzle. The cover also includes a locking rib which can be brought to bear against the nozzle when the nozzle is fully received in its seat to help retain the nozzle in place. In the Scott et al. U.S. Pat. No. 5,699,962, a sprinkler unit has a nozzle in which the sprinkler body has an outlet having a nozzle receiving socket for a removable nozzle mounted in the sprinkler outlet. The lodging device in the socket is used for latching engagement with the nozzle for retaining the nozzle in the socket. In the Hart U.S. Pat. No. 3,799,453, a quick disconnect nozzle for an irrigation sprinkler is fitted with a screw threaded connection to the sprinkler outlet. The Anuskiewicz U.S. Pat. No. 6,871,795 is an irrigation sprinkler with an easily removable nozzle.

The present rapid change nozzle is inserted from the side of the sprinkler body outlet and uses a lever action to force the nozzle passageway against the outlet passageway and against an O-ring seal and is firmly snapped in place.

SUMMARY OF THE INVENTION

An irrigation sprinkler has a rapid change nozzle having a sprinkler housing having a passageway therethrough having an inlet for connecting to a source of water and an outlet therefrom. The outlet has an open side area for inserting a nozzle in one side thereof and a recessed area on the other side thereof. The sprinkler housing has a latching catch adjacent the outlet open side. A nozzle has a nozzle passageway therethrough and has a protrusion or tongue on one side thereof shaped to fit into the housing outlet recess and has a latching arm extending from the other side thereof and shaped to engage the housing latching catch so that a nozzle can be inserted through the side housing window and the nozzle tongue inserted in the housing outlet recess to axially align the nozzle passageway with the housing passageway so that a nozzle can be rapidly inserted and removed from the sprinkler housing. The sprinkler housing passageway outlet has an O-ring seal therearound for sealing the nozzle to the housing outlet. A latching catch has, in one configuration, two spaced latching recesses for inserting a pair of spaced latching arms, each having a latching tab thereon for engaging the spaced latching recesses for locking the nozzle to the sprinkler housing. Each latching arm has a handle formed thereon. The nozzle can be made of a polymer or plastic material as desired. The nozzle tongue can have a rounded end portion that allows the nozzle to be rotated in the nozzle outlet recess when latching the nozzle to the housing.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
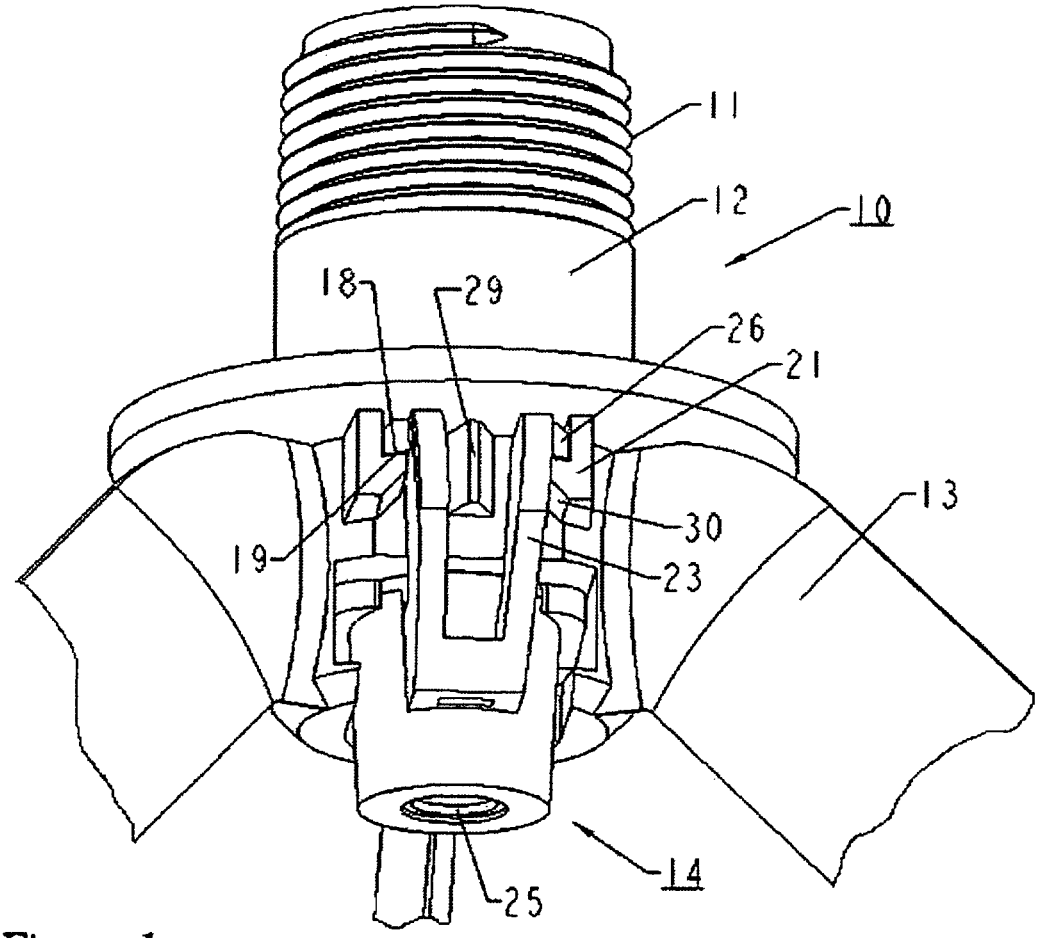
FIG. 1 shows a rapid change nozzle in accordance with the present invention inserted into an irrigation sprinkler head.

Referring to the drawings of FIGS. 1 through 6, a partial irrigation sprinkler head 10 has a threaded attachment 11 for a water inlet 12 and has arms for holding a water deflector 13 (not shown) and has a sprinkler nozzle 14 attached thereto, as seen in FIG. 1. The sprinkler body has a water inlet 12 and a water outlet 15. The water outlet directs water through a nozzle for controlling the discharge of the water onto a deflection surface and might have an O-ring seal mounted therein. The outlet 15 of the nozzle sprinkler body 10 has a side opening or window 17 for inserting the rapid change nozzle 14. The sprinkler outlet 15 has a recessed area 20 on the opposite side of the outlet 15 from the opening 17. Latching members 21 are formed on the sprinkler body 10 adjacent to and above the side window 17. The rapid change nozzle 14 has a protrusion or tongue 22 on one side and a pair of arms 23 on the other side thereof with the nozzle body portion 24 having the nozzle passageway 25 going therethrough. The tongue 22 may be of a rounded shape and is sized to fit in the recessed area 20 in the outlet of the sprinkler body. A pair of arms 23 on the nozzle has a pair of snap connectors or latching members 26 for engaging the sprinkler body latching members 21.

Figure 2:
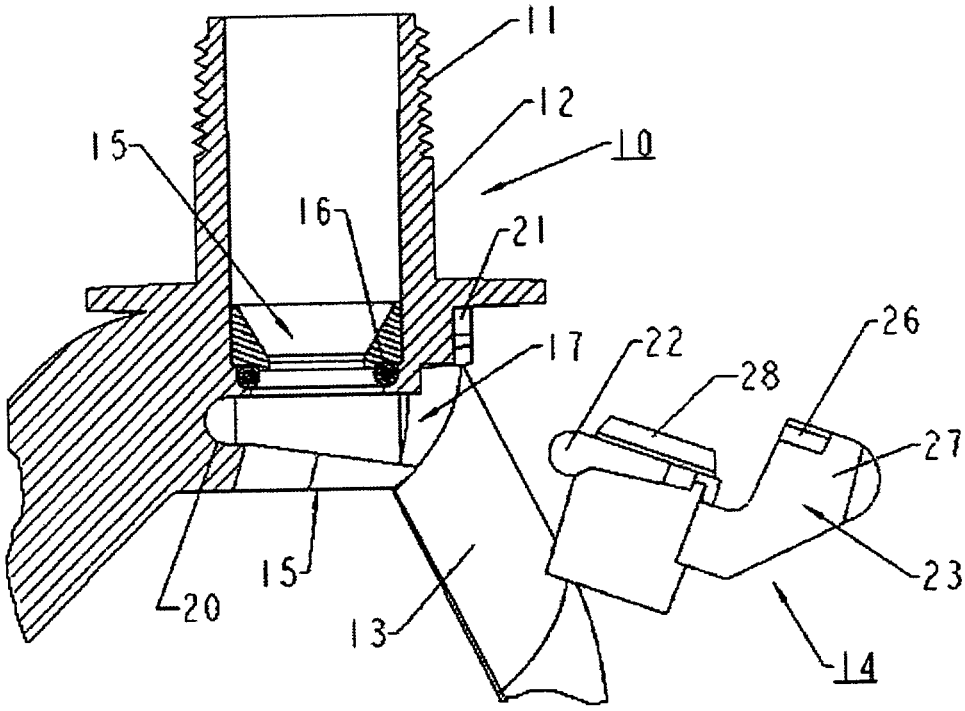
FIG. 2 is a sectional view of a rapid change nozzle being inserted into a sprinkler head.
Figure 3:
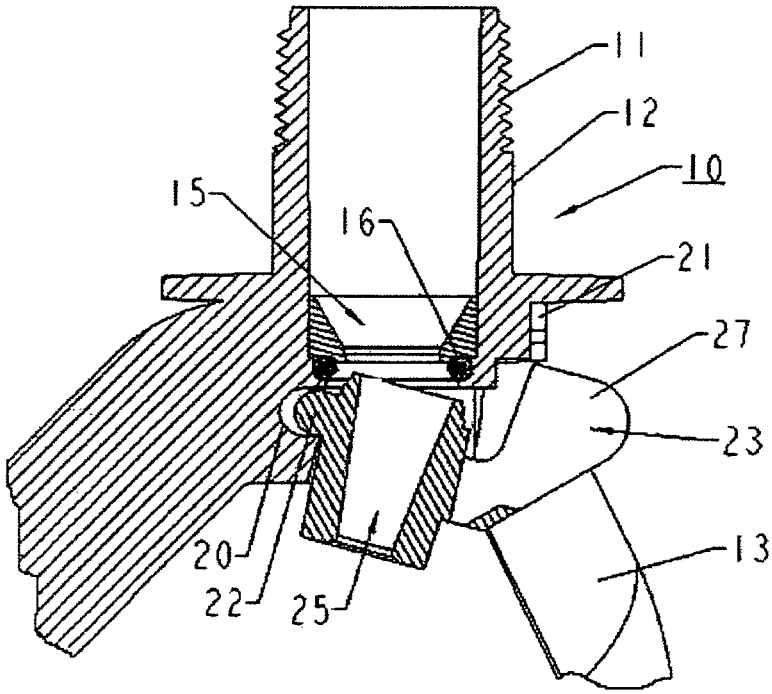
FIG. 3 is a sectional view of the nozzle of FIGS. 1 and 2 being attached to the sprinkler head.
Figure 4:
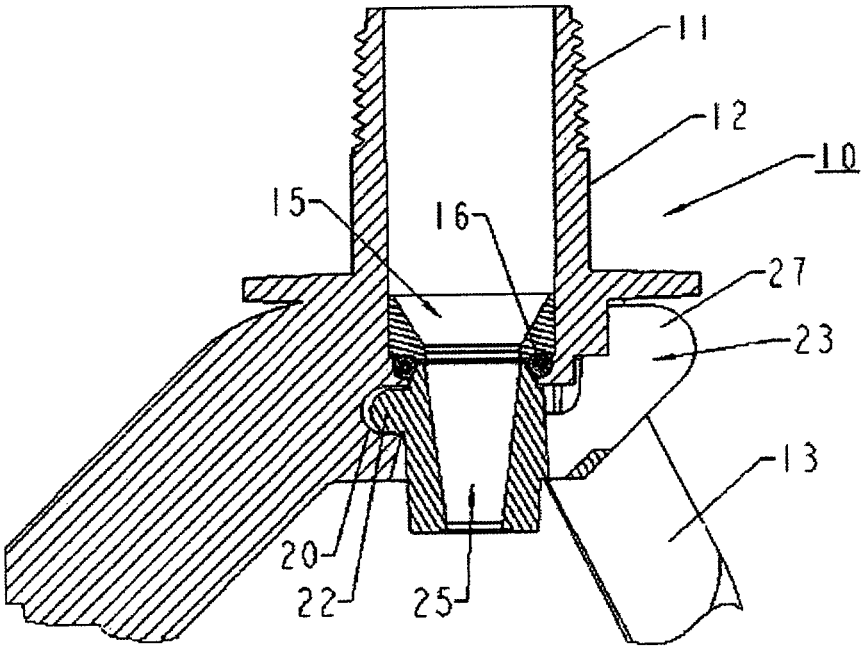
FIG. 4 is a sectional view of the nozzle of FIGS. 1 through 3.
Figure 5:
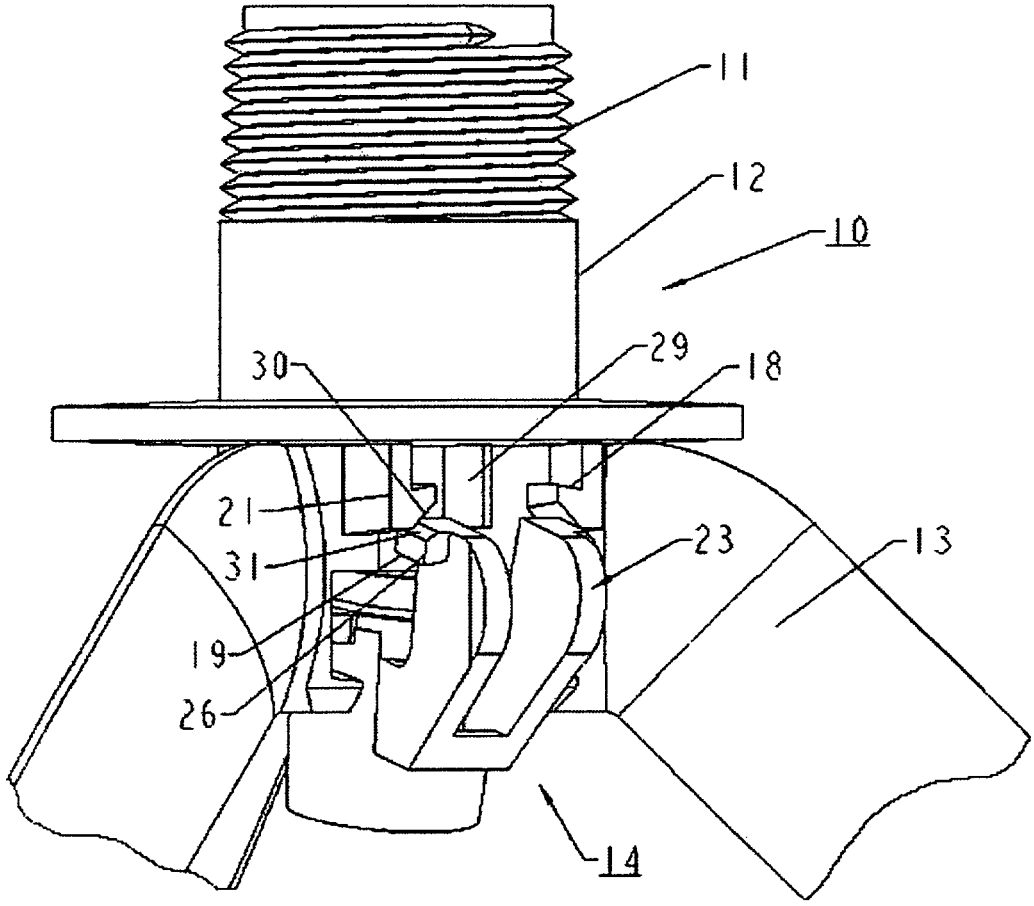
FIG. 5 is a perspective view of the rapid change nozzle of FIGS. 1 through 4 inserted and before being snapped into place.
Figure 6:
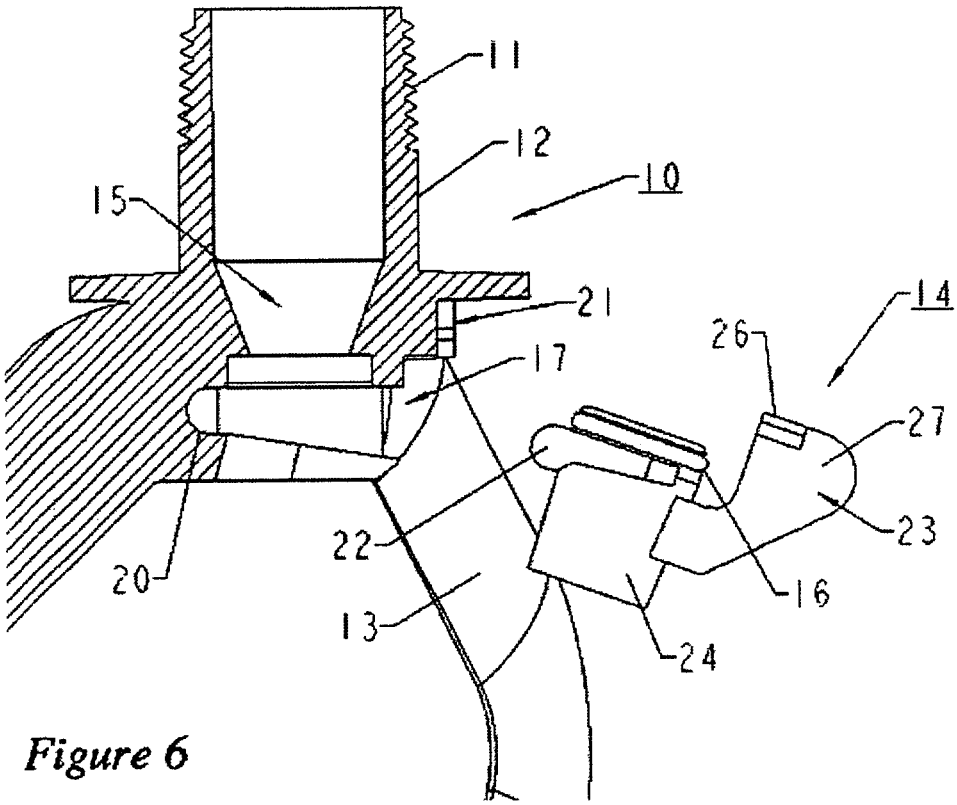
FIG. 6 is a sectional view of the rapid change nozzle of FIG. 2 having the O-ring seal on the nozzle.

In operation, the rapid change nozzle 14, as seen in FIGS. 2 and 6, can be grasped by handle portions 27 on the arms 23 and inserted through the side window 17 of the inlet 12 and has the tongue 22 inserted into the recess 20 of the sprinkler body outlet 15 allowing the nozzle 14 to be rotated with a lever action on the tongue 22 in the recess 20 until the lip 28 of the nozzle is pressed against the O-ring seal 16. Arms 23 are pressed together to move the snap tabs 26 inward towards each other, as seen in FIG. 5, where they can be snapped into position in the latching portions 21 on either side thereof so that when the handles are released, the nozzle is locked in place, aligning the passageway 25 with the outlet passageway. The latching portions 21 also has angled portions 30 while the catch tabs 26 have an angled surface 31 so that merely pushing the nozzle arms up will automatically latch the nozzle in place. The latching portion 21 may also have angled top portions 18 while the catch tabs 26 have matching angled bottom portions 19. When the nozzle 14 is locked in place and under pressure, these angled portions 18 and 19 together prevent the nozzle arms 23 from moving inward and becoming disengaged.

As seen in FIGS. 1 and 5, a centering element 29 is provided between the latching portions 21 on the sprinkler body 10 to aid in the removal of nozzle 14. When the nozzle arms 23 are squeezed together, they sandwich the centering element 29 between themselves. This sandwiching automatically centers the nozzle catch tabs 26 between the latching portions 21 and guaranties complete disengagement of the latching mechanism 21 and 26 for nozzle removal.

It should be clear at this time that a rapid change nozzle for an irrigation sprinkler has been provided which provides a downwardly or upwardly flowing outlet to be maintained for directing a stream of water against a deflector surface or the like and which allows a nozzle to be easily inserted from the side which is easily accessible for inserting and removing the nozzle. However, the present invention is not to be construed as limited to the forms shown which is to be considered illustrative rather than restrictive.

We claim:

1. A sprinkler comprising:

a sprinkler housing having a passageway therethrough having an inlet for connecting to a source of water and an outlet therefrom, said outlet having an open side area for inserting a nozzle on one side and having a recess on the other side thereof, said housing having a latching catch adjacent to said outlet open side; and a nozzle having a nozzle passageway therethrough and having a tongue on one side thereof shaped to fit into said housing outlet recess and having at least one latching arm extending from the other side therefrom and shaped to engage said housing latching catch when said nozzle is inserted through said outlet open side and said nozzle tongue is inserted in said housing outlet recess to generally axially align said nozzle passageway with said housing passageway;

whereby a nozzle can be rapidly inserted and removed from said sprinkler housing.

2. The sprinkler in accordance with claim 1 in which said sprinkler housing passageway outlet has an o-ring seal therearound for sealing said nozzle to said sprinkler housing outlet.

3. The sprinkler in accordance with claim 1 in which said latching catch has at least one latching recess.

4. The sprinkler in accordance with claim 3 in which said latching catch has a pair of said latching recesses spaced one from the other.

5. The sprinkler in accordance with claim 4 in which said nozzle has a pair of said latching arms, each said latching arm having a latching tab thereon for engaging one of said pair of spaced latching recesses for locking said nozzle to said sprinkler housing.

6. The sprinkler in accordance with claim 5 in which each said latching recess has an angled surface and each said latching tab has an angled surface for engaging one said latching catch recess angled surface.

7. The sprinkler in accordance with claim 5 in which said sprinkler body has a centering member located between said pair of latching catch latching recesses.

8. The sprinkler in accordance with claim 5 in which said latching catch forms a yoke having said pair of latching recesses facing each other.

9. The sprinkler in accordance with claim 8 in which said pair of spaced latching arms are pressed together to fit within said yoke and released to allow each said tab to fit into one said latching recess to thereby removably lock said nozzle to said sprinkler housing.

10. The sprinkler in accordance with claim 9 in which each said latching arm has a handle thereon.

11. The sprinkler in accordance with claim 9 in which said nozzle is made of a polymer material.

12. The sprinkler in accordance with claim 1 in which said nozzle tongue has a rounded end portion to allow said nozzle to be rotated in the nozzle outlet recess for latching the nozzle to the housing.

13. A sprinkler comprising:

a sprinkler housing having a housing passageway therethrough having an inlet for connecting to a source of water and an outlet therefrom, said outlet having a side window for inserting a nozzle from the side of said housing passageway, said side window being generally perpendicular to said housing passageway;

a nozzle having a nozzle passageway therethrough, said nozzle being shaped to fit into said sprinkler housing side window and axially aligning said sprinkler housing passageway and said nozzle passageway;

latching means for removably latching said nozzle to said sprinkler housing;

whereby a nozzle can be rapidly inserted and removed from said sprinkler housing.

14. The sprinkler in accordance with claim 13 in which said latching means includes a pair of spaced protrusions each having a notch therein.

15. The sprinkler in accordance with claim 14 in which said latching means includes a pair of spaced arms each having a tab thereon for engaging one said spaced protrusion tab for engaging said notches to removably latch said nozzle to said sprinkler housing.

* * * * *

UNITED STATES PATENT AND TRADEMARK OFFICE

CERTIFICATE OF CORRECTION

PATENT NO. : 8,556,196 B2
APPLICATION NO. : 12/215661
DATED : October 15, 2013
INVENTOR(S) : Jerry D. Lawyer et al.

It is certified that error appears in the above-identified patent and that said Letters Patent is hereby corrected as shown below:

Title Page, item [73] under "Assignee" replace "Senniger Irrigation Inc." with --Senninger Irrigation Inc.--.

Signed and Sealed this
Twenty-fourth Day of December, 2013

Margaret A. Focarino

Margaret A. Focarino
*Commissioner for Patents of the United States Patent and Trademark Office*